US009568002B2

(12) United States Patent
Duppert et al.

(10) Patent No.: US 9,568,002 B2
(45) **Date of Patent: *Feb. 14, 2017**

(54) KEY COUPLING AND SCROLL COMPRESSOR INCORPORATING SAME

(71) Applicants: Ronald J. Duppert, Fayetteville, NY (US); James W. Bush, Skaneateles, NY (US)

(72) Inventors: Ronald J. Duppert, Fayetteville, NY (US); James W. Bush, Skaneateles, NY (US)

(73) Assignee: BITZER Kuehlmaschinenbau GmbH, Sindelfingen (DE)

( * ) Notice: Subject to any disclaimer, the term of this patent is extended or adjusted under 35 U.S.C. 154(b) by 0 days.

This patent is subject to a terminal disclaimer.

(21) Appl. No.: 14/715,059

(22) Filed: May 18, 2015

(65) Prior Publication Data

US 2015/0247500 A1 Sep. 3, 2015

Related U.S. Application Data

(63) Continuation-in-part of application No. 12/015,571, filed on Jan. 17, 2008, now abandoned.

(51) Int. Cl.

| | |
|---|---|
| ***F04C 29/00*** | (2006.01) |
| ***F01C 17/06*** | (2006.01) |
| ***F04C 18/02*** | (2006.01) |

(52) U.S. Cl.

CPC ..... *F04C 29/005* (2013.01); *F01C 17/066* (2013.01); *F04C 18/0215* (2013.01); *F04C 18/0223* (2013.01)

(58) Field of Classification Search

CPC .... F01C 17/066; F04C 29/005; F04C 18/0215

(Continued)

(56) References Cited

U.S. PATENT DOCUMENTS

| | | | |
|---|---|---|---|
| 4,655,696 | A | 4/1987 | Utter |
| 4,696,630 | A | 9/1987 | Sakata et al. |

(Continued)

FOREIGN PATENT DOCUMENTS

| | | | |
|---|---|---|---|
| EP | 0479412 | A1 | 4/1992 |
| JP | 07174081 | A | 7/1995 |

(Continued)

OTHER PUBLICATIONS

Machine Translation of Japanese Patent Publication JP 07-305687, published on Nov. 5, 1994.*

*Primary Examiner* — Mary A Davis
(74) *Attorney, Agent, or Firm* — Reinhart Boerner Van Deuren P.C.

(57) ABSTRACT

A scroll compressor includes a fixed scroll compressor body and a moveable scroll compressor body that are arranged for relative orbital movement relative to one another to facilitate compression of refrigerant. The scroll compressor includes a key coupling acting upon the moveable scroll compressor body. The key coupling includes a ring body with a plurality of keys, with key contact surfaces, each of the keys projecting axially from the ring body. The key coupling includes four keys in separate quadrants defined by perpendicular lateral axes. The key coupling guides orbital movement of the moveable scroll compressor body along a linear translational path along a lateral axis.

18 Claims, 9 Drawing Sheets

(58) Field of Classification Search
USPC ..... 418/55.1, 55.2, 55.3, 55.4, 55.5; 464/77, 464/102, 103, 104, 105
See application file for complete search history.

(56) References Cited

U.S. PATENT DOCUMENTS

| | | | | |
|---|---|---|---|---|
| 4,927,339 | A | 5/1990 | Riffe et al. | |
| 5,080,566 | A | 1/1992 | Sakata et al. | |
| 5,090,878 | A | 2/1992 | Haller | |
| 5,141,421 | A | 8/1992 | Bush et al. | |
| 5,320,506 | A | 6/1994 | Fogt | |
| 5,403,172 | A * | 4/1995 | Blass | F01C 17/066 418/55.3 |
| 5,427,511 | A | 6/1995 | Caillat et al. | |
| 5,538,408 | A | 7/1996 | Blass et al. | |
| 5,582,312 | A | 12/1996 | Niles et al. | |
| 5,775,893 | A * | 7/1998 | Takao | F01C 17/066 418/55.3 |
| 6,227,830 | B1 | 5/2001 | Fields et al. | |
| 6,398,530 | B1 | 6/2002 | Hasemann | |
| 6,439,867 | B1 | 8/2002 | Clendenin | |
| 6,488,489 | B2 | 12/2002 | Williams et al. | |
| 6,682,327 | B2 | 1/2004 | Milliff et al. | |
| 6,761,541 | B1 | 7/2004 | Clendenin | |
| 6,814,551 | B2 | 11/2004 | Kammhoff et al. | |
| 6,960,070 | B2 | 11/2005 | Kammhoff et al. | |
| 7,112,046 | B2 | 9/2006 | Kammhoff et al. | |
| 7,918,658 | B2 | 4/2011 | Bush et al. | |
| 2009/0185921 | A1 | 7/2009 | Beagle et al. | |
| 2009/0185926 | A1 | 7/2009 | Bush | |
| 2009/0185928 | A1 | 7/2009 | Bush et al. | |
| 2009/0185929 | A1 | 7/2009 | Duppert et al. | |
| 2009/0185930 | A1 | 7/2009 | Duppert et al. | |
| 2009/0185931 | A1 | 7/2009 | Beagle et al. | |
| 2009/0185932 | A1 | 7/2009 | Beagle et al. | |
| 2009/0185933 | A1 | 7/2009 | Bush et al. | |
| 2009/0185934 | A1 | 7/2009 | Bush | |

FOREIGN PATENT DOCUMENTS

| | | | |
|---|---|---|---|
| JP | 07-301101 | A | 11/1995 |
| JP | 07305687 | A | 11/1995 |
| KR | 100208096 | B1 | 7/1999 |

* cited by examiner

KEY COUPLING AND SCROLL COMPRESSOR INCORPORATING SAME

CROSS-REFERENCE TO RELATED PATENT APPLICATION

This patent application is a continuation-in-part of co-pending U.S. patent application Ser. No. 12/015,571, filed Jan. 17, 2008, the entire teachings and disclosure of which are incorporated herein by reference thereto.

FIELD OF THE INVENTION

The present invention generally relates to scroll compressors for compressing refrigerant, and, more particularly, to key couplings often referred to in the art as "Oldham Couplings" for preventing relative angular movement between the scroll members as they orbit relative to each other.

BACKGROUND OF THE INVENTION

A scroll compressor is a certain type of compressor that is used to compress refrigerant for such applications as refrigeration, air conditioning, industrial cooling and freezer applications, and/or other applications where compressed fluid may be used. Such prior scroll compressors are known, for example, as exemplified in U.S. Pat. No. 6,398,530 to Hasemann; U.S. Pat. No. 6,814,551, to Kammhoff et al.; U.S. Pat. No. 6,960,070 to Kammhoff et al.; and U.S. Pat. No. 7,112,046 to Kammhoff et al., all of which are assigned to a Bitzer entity closely related to the present assignee. As the present disclosure pertains to improvements that can be implemented in these or other scroll compressor designs, the entire disclosures of U.S. Pat. Nos. 6,398,530; 7,112,046; 6,814,551; and 6,960,070 are hereby incorporated by reference in their entireties.

As is exemplified by these patents, scroll compressors conventionally include an outer housing having a scroll compressor contained therein. A scroll compressor includes fixed and moveable scroll compressor members. A first compressor member is typically arranged stationary and fixed in the outer housing. A second scroll compressor member is moveable relative to the first scroll compressor member in order to compress refrigerant between respective scroll ribs which rise above the respective bases and engage in one another. Conventionally the moveable scroll compressor member is driven about an orbital path about a central axis for the purposes of compressing refrigerant. An appropriate drive unit, typically an electric motor, is provided usually within the same housing to drive the moveable scroll member.

One of the common approaches for preventing relative rotation or movement between the scroll members as they orbit relative to each other is through the use of what is commonly referred to as an "Oldham coupling". As exemplified by the patents referenced herein, an Oldham coupling typically includes a ring structure that has two sets of keys. One set of keys slides in one linear direction on a surface of the orbiting scroll compressor body while the other set of keys slides at right angles on a fixed surface such as along the fixed scroll compressor body as illustrated but not numbered in the '551 patent (see also the Oldham key coupling at 90 in the '530 patent). For one of the set of keys, the orbiting scroll compressor body will commonly employ two slots spaced 180° apart in separate quadrants defined by the mutually perpendicular axes as for example is illustrated in FIG. 10. Such slots receive the two keys of the Oldham coupling guiding linear translational movement along one lateral axis. As also shown in FIG. 10, the slots are typically provided for through the provision of outwardly projecting ears. The moveable scroll compressor body slots are positioned in substantial spaced relation from the respective axes so as to provide for carrying moment loads necessary to prevent relative angular movement between the moveable and fixed scroll compressor bodies.

Embodiments of the present invention are directed towards improvements over prior Oldham coupling configurations and scroll compressors incorporating the same.

BRIEF SUMMARY OF THE INVENTION

In one aspect, embodiments of the present invention provide a scroll compressor that includes a housing, and scroll compressor bodies including a fixed scroll compressor body and a moveable scroll compressor body. The moveable scroll compressor body is moveable relative to the housing. The scroll compressor bodies have respective bases and respective scroll ribs that project from the respective bases and which mutually engage. The scroll ribs generally surrounding a central axis. The scroll compressor bodies are moveable relative to one another along first and second lateral axes. The first and second lateral axes and the central axis are generally mutually perpendicular. A key coupling acts upon the moveable scroll compressor body. The moveable scroll compressor body is moveable relative to the key coupling along the second lateral axis. The key coupling has a first pair of cooperating sliding contacts with the moveable scroll compressor body including first and second contacts located on a same side of the first lateral axis, and on opposite sides of the second lateral axis, respectively. First and second keys respectively provide the first and second contacts. The first and second contacts are spaced such that, when the moveable scroll compressor body is centered on the key coupling, any line connecting the first contact to the second contact does not intersect any portion of the scroll rib on the moveable scroll compressor body.

In a particular embodiment, a second pair of cooperating sliding contacts lies between the key coupling and the moveable scroll compressor body, and includes third and fourth contacts located on an opposite side of the first lateral axis relative to the first and second contacts. The third and fourth contacts are on opposite sides of the second lateral axis, respectively. Third and fourth keys respectively provide the third and fourth contacts. The third and fourth contacts may be spaced such that when the moveable scroll compressor body is centered on the key coupling any line from the third contact to the fourth contact will not intersect any portion of the scroll rib on the moveable scroll compressor body.

In certain embodiments, the key coupling includes a ring body. The first, second, third, and fourth keys project axially from the ring body. Each key is in a separate one of the four quadrants defined by the first and second lateral axes. In some embodiments, the key coupling is slideable relative to the fixed scroll compressor body along the first lateral axis. The key coupling includes fifth and sixth keys projecting axially from the ring body. The fifth and sixth keys are received in first and second keyway slots defined by the fixed scroll compressor body, respectively. The fifth and sixth keys and the first and second keyway slots are aligned on the first lateral axis.

In a particular embodiment, the ring body has four mounting zones. A mounting zone is a portion of the ring body that connects one of the fifth and sixth keys to an adjacent one of the first, second, third and fourth keys. Each of the mounting zones has a top surface, and each of the four top surfaces includes a flat portion, and each of the four flat portions lies in a common plane. In certain embodiments, the fifth and sixth keys are aligned with the first lateral axis and the fifth and sixth keys are spaced further from the second lateral axis than any of the at least four keys. In some embodiments, the first key is spaced from 35 degrees to 55 degrees relative to the fifth key, and the second key is spaced from negative 35 degrees to negative 55 degrees relative to the fifth key. Further, the third key is spaced from 35 degrees to 55 degrees relative to the sixth key, and the fourth key is spaced from negative 35 degrees to negative 55 degrees relative to the sixth key.

In an alternate embodiment, the first key is spaced from 25 degrees to 65 degrees relative to the fifth key, and the second key is spaced from negative 25 degrees to negative 65 degrees relative to the fifth key. In this alternate embodiment, the third key is spaced from 25 degrees to 65 degrees relative to the sixth key, and the fourth key is spaced from negative 25 degrees to negative 65 degrees relative to the sixth key. In a further embodiment, the six keys are spaced somewhat uniformly around the ring body such that any two adjacent keys have an angular separation of between 55 degrees and 65 degrees. In specific embodiments, each of the six keys is spaced 60 degrees from adjacent keys.

The first and second keys may be located on a first portion of the ring body furthest from one side of the first lateral axis, and the third and fourth keys are located on a second portion of the ring body furthest from another side of the first lateral axis opposite the one side.

In another aspect, embodiments of the present invention provide a scroll compressor that includes scroll compressor bodies including a fixed scroll compressor body and a moveable scroll compressor body. The fixed and moveable scroll compressor bodies have respective bases and respective scroll ribs that project from the respective bases and which mutually engage. The scroll ribs generally surrounding a central axis. The scroll compressor bodies are moveable relative to one another along first and second lateral axes. The first and second lateral axes and the central axis all intersect at a point and that is generally mutually perpendicular. A key coupling acts upon the moveable scroll compressor body. The moveable scroll compressor body is linearly moveable relative to the key coupling by a contact interface between the key coupling and the moveable scroll compressor body. The contact interface is provided by four keys comprising first and second keys which respectively provide first and second contact surfaces, and comprising third and fourth keys which respectively provide third and fourth contact surfaces. The first and second contact surfaces are located on a same side of the first lateral axis, and on opposite sides of the second lateral axis. Third and fourth contact surfaces are located on an opposite side of the first lateral axis relative to the first and second contact surfaces. The third and fourth contact surfaces are on opposite sides of the second lateral axis. The key coupling includes fifth and sixth keys configured to interface with the fixed scroll compressor body. The fifth and sixth keys are aligned with the first lateral axis, and the fifth and sixth keys are spaced further from the second lateral axis than any of the at least four keys.

In a particular embodiment, the ring body has four mounting zones. A mounting zone is a portion of the ring body that connects one of the fifth and sixth keys to an adjacent one of the first, second, third and fourth keys. Each of the four mounting zones has a top surface, and each of the four top surfaces includes a flat portion, and each of the four flat portions lies in a common plane.

The first and second keys may be located on a first portion of the ring body furthest from one side of the first lateral axis, and the third and fourth keys may be located on a second portion of the ring body furthest from another side of the first lateral axis opposite the one side. In some embodiments, the first and second keys are spaced such that, when the moveable scroll compressor body is centered on the key coupling, any line connecting the first contact surface to the second contact surface does not intersect any portion of the scroll rib on the moveable scroll compressor body. Additionally, the third and fourth keys may be spaced such that, when the moveable scroll compressor body is centered on the key coupling, any line connecting the third contact surface to the fourth contact surface does not intersect any portion of the scroll rib on the moveable scroll compressor body.

In a particular embodiment, the first key is spaced from 35 degrees to 55 degrees relative to the fifth key, and the second key is spaced from negative 35 degrees to negative 55 degrees relative to the fifth key. In this embodiment, the third key is spaced from 35 degrees to 55 degrees relative to the sixth key, and the fourth key is spaced from negative 35 degrees to negative 55 degrees relative to the sixth key. In an alternate embodiment, the first key is spaced from 25 degrees to 65 degrees relative to the fifth key, and the second key is spaced from negative 25 degrees to negative 65 degrees relative to the fifth key. In this alternate embodiment, the third key is spaced from 25 degrees to 65 degrees relative to the sixth key, and the fourth key is spaced from negative 25 degrees to negative 65 degrees relative to the sixth key.

In a further embodiment, the six keys are spaced somewhat uniformly around the ring body such that any two adjacent keys have an angular separation of between 55 degrees and 65 degrees. In specific embodiments, each of the six keys is spaced 60 degrees from adjacent keys.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

Figure 1:
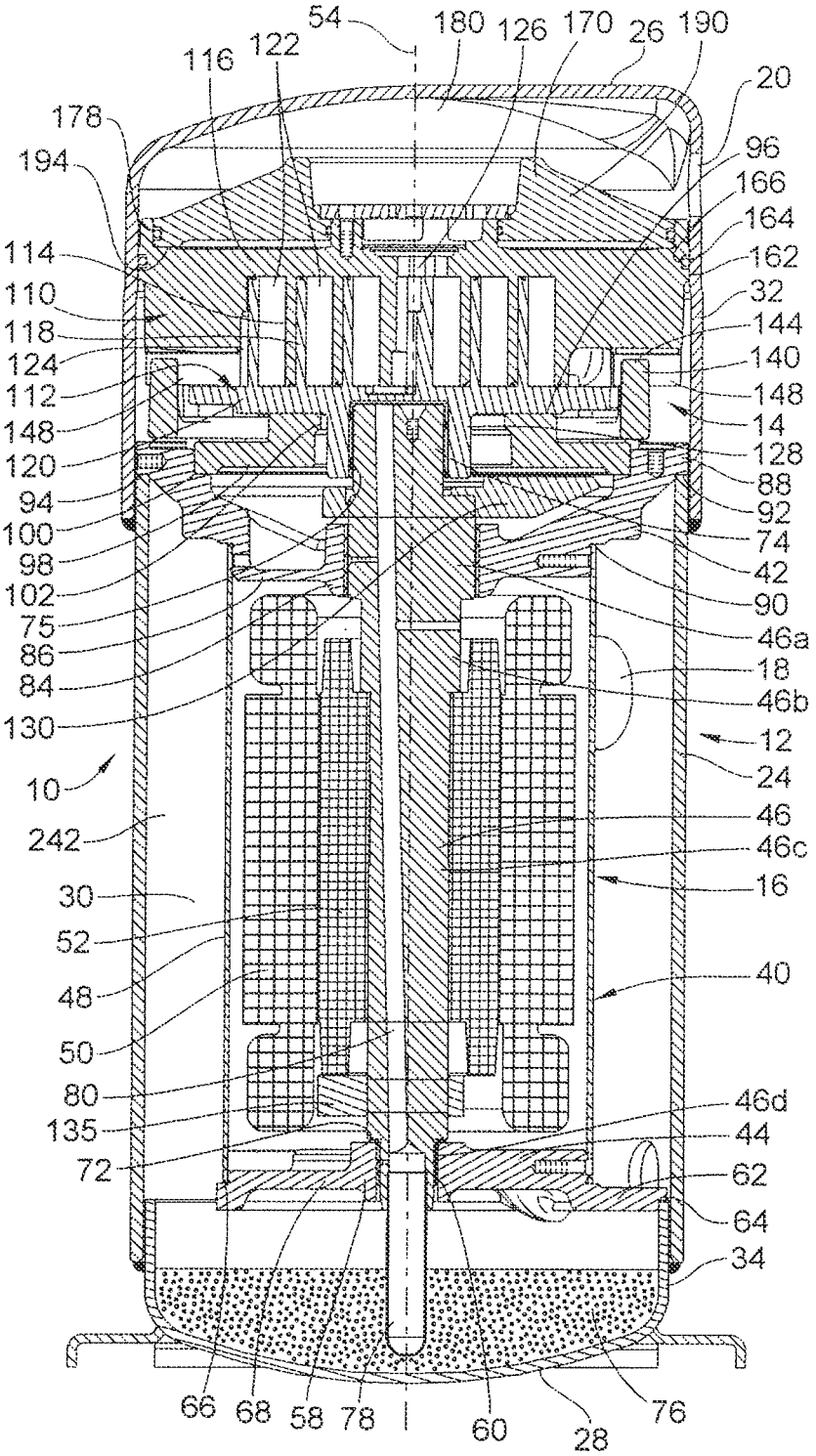
FIG. 1 is a cross section of a scroll compressor assembly in accordance with an embodiment of the present invention.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

An embodiment of the present invention is illustrated in the figures as a scroll compressor assembly 10 generally including an outer housing 12 in which a scroll compressor 14 can be driven by a drive unit 16. The scroll compressor assembly may be arranged in a refrigerant circuit for refrigeration, industrial cooling, freezing, air conditioning or other appropriate applications where compressed fluid is desired. Appropriate connection ports provide for connection to a refrigeration circuit and include a refrigerant inlet port 18 and a refrigerant outlet port 20 extending through the outer housing 12. The scroll compressor assembly 10 is operable through operation of the drive unit 16 to operate the scroll compressor 14 and thereby compress an appropriate refrigerant or other fluid that enters the refrigerant inlet port 18 and exits the refrigerant outlet port 20 in a compressed high pressure state.

The outer housing 12 may take many forms. In the preferred embodiment, the outer housing includes multiple shell sections and preferably three shell sections to include a central cylindrical housing section 24, a top end housing section 26 and a bottom end housing section 28. Preferably, the housing sections 24, 26, 28 are formed of appropriate sheet steel and welded together to make a permanent outer housing 12 enclosure. However, if disassembly of the housing is desired, other housing provisions can be made that can include metal castings or machined components.

The central housing section 24 is preferably cylindrical and telescopically interfits with the top and bottom end housing sections 26, 28. This forms an enclosed chamber 30 for housing the scroll compressor 14 and drive unit 16. Each of the top and bottom end housing sections 26, 28 are generally dome shaped and include respective cylindrical side wall regions 32, 34 to mate with the center section 24 and provide for closing off the top and bottom ends of the outer housing 12. As can be seen in FIG. 1, the top side wall region 32 telescopically overlaps the central housing section 24 and is exteriorly welded along a circular welded region to the top end of the central housing section 24. Similarly the bottom side wall region 34 of the bottom end housing section 28 telescopically interfits with the central housing section 24 (but is shown as being installed into the interior rather than the exterior of the central housing section 24) and is exteriorly welded by a circular weld region.

The drive unit 16 may preferably take the form of an electrical motor assembly 40, which is supported by upper and lower bearing members 42, 44. The motor assembly 40 operably rotates and drives a shaft 46. The electrical motor assembly 40 generally includes an outer annular motor housing 48, a stator 50 comprising electrical coils and a rotor 52 that is coupled to the drive shaft 46 for rotation together. Energizing the stator 50 is operative to rotatably drive the rotor 52 and thereby rotate the drive shaft 46 about a central axis 54.

Figure 4:
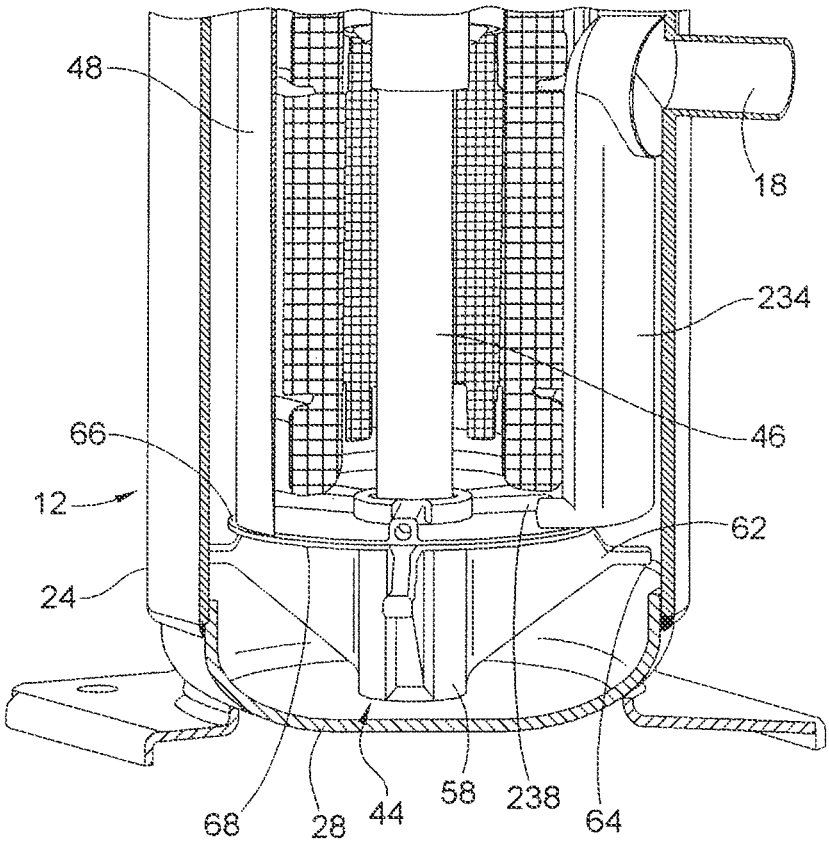
FIG. 4 is a partial cross section and cut-away view of a lower portion of the embodiment of FIG. 1.

With reference to FIGS. 1 and 4, the lower bearing member 44 includes a central generally cylindrical hub 58 that includes a central bushing and opening to provide a cylindrical bearing 60 to which the drive shaft 46 is journaled for rotational support. A plurality of arms 62 and typically at least three arms project radially outward from the bearing central hub 58 preferably at equally spaced angular intervals. These support arms 62 engage and are seated on a circular seating surface 64 provided by the terminating circular edge of the bottom side wall region 34 of the bottom outer housing section 28. As such, the bottom housing section 28 can serve to locate, support and seat the lower bearing member 44 and thereby serves as a base upon which the internal components of the scroll compressor assembly can be supported.

The lower bearing member 44 in turn supports the cylindrical motor housing 48 by virtue of a circular seat 66 formed on a plate-like ledge region 68 of the lower bearing member 44 that projects outward along the top of the central hub 58. The support arms 62 also preferably are closely toleranced relative to the inner diameter of the central housing section. The arms 62 may engage with the inner diameter surface of the central housing section 24 to centrally locate the lower bearing member 44 and thereby maintain position of the central axis 54. This can be by way of an interference and press-fit support arrangement between the lower bearing member 44 and the outer housing 12 (See e.g. FIG. 4). Alternatively according to a more preferred configuration, as shown in FIG. 1, the lower bearing engages with the lower housing section 28 which is in turn attached to center section 24. Likewise, the outer motor housing 48 may be supported with an interference and press-fit along the stepped seat 66 of the lower bearing member 44. As shown, screws may be used to securely fasten the motor housing to the lower bearing member 44.

The drive shaft 46 is formed with a plurality of progressively smaller diameter sections **46*a*-46*d* which are aligned concentric with the central axis 54. The smallest diameter section 46*d* is journaled for rotation within the lower bearing member 44 with the next smallest section 46*c* providing a step 72 for axial support of the drive shaft 46 upon the lower bearing member 44. The largest section 46*a* is journaled for rotation within the upper bearing member 42**.

The drive shaft 46 further includes an offset eccentric drive section 74 that has a cylindrical drive surface 75 about an offset axis that is offset relative to the central axis 54. This offset drive section 74 is journaled within a cavity of the moveable scroll member of the scroll compressor 14 to drive the moveable member of the scroll compressor about an orbital path when the drive shaft 46 is spun about the central axis 54. To provide for lubrication of all of these bearing surfaces, the outer housing 12 provides an oil lubricant sump 76 at the bottom end in which suitable oil lubricant is provided. The drive shaft 46 has an oil lubricant pipe and impeller 78 that acts as an oil pump when the drive shaft is spun and thereby pumps oil out of the lubricant sump 76 into an internal lubricant passageway 80 defined within the drive shaft 46. During rotation of the drive shaft 46, centrifugal force acts to drive lubricant oil up through the lubricant passageway 80 against the action of gravity. The lubricant passageway 80 includes various radial passages as shown to feed oil through centrifugal force to appropriate bearing surfaces and thereby lubricate sliding surfaces as may be desired.

The upper bearing member 42 includes a central bearing hub 84 into which the largest section 46*a* of the drive shaft 46 is journaled for rotation. Extending outward from the bearing hub 84 is a support web 86 that merges into an outer peripheral support rim 88. Provided along the support web 86 is an annular stepped seating surface 90 which may have an interference and press-fit with the top end of the cylindrical motor housing 48 to thereby provide for axial and radial location. The motor housing 48 may also be fastened with screws to the upper bearing member 42. The outer peripheral support rim 88 also may include an outer annular stepped seating surface 92 which may have an interference and press-fit with the outer housing 12. For example, the outer peripheral rim 88 can engage the seating surface 92 axially, that is it engages on a lateral plane perpendicular to axis 54 and not through a diameter. To provide for centering there is provided a diametric fit just below the surface 92 between the central housing section 24 and the support rim 88. Specifically, between the telescoped central and top-end housing sections 24, 26 is defined in internal circular step 94, which is located axially and radially with the outer annular step 92 of the upper bearing member 42.

The upper bearing member 42 also provides axial thrust support to the moveable scroll member through a bearing support via an axial thrust surface 96. While this may be integrally provided by a single unitary component, it is shown as being provided by a separate collar member 98 that is interfit with the upper portion of the upper bearing member 42 along stepped annular interface 100. The collar member 98 defines a central opening 102 that is a size large enough to provide for receipt of the eccentric offset drive section 74 and allow for orbital eccentric movement thereof that is provided within a receiving portion of an orbiting scroll body, or moveable scroll compressor body 112.

Turning in greater detail to the scroll compressor 14, the scroll compressor body is provided by fixed and moveable scroll compressor bodies which preferably include a stationary fixed scroll compressor body 110 and a moveable scroll compressor body 112. The moveable scroll compressor body 112 is arranged for orbital movement relative to the fixed scroll compressor body 110 for the purpose of compressing refrigerant. The fixed scroll compressor body includes a first rib 114 projecting axially from a plate-like base 116 and is designed in the form of a spiral. Similarly, the second moveable scroll compressor body 112 includes a second scroll rib 118 projecting axially from a plate-like base 120 and is in the design form of a similar spiral. The scroll ribs 114, 118 engage in one another and abut sealingly on the respective base surfaces 120, 116 of the respectively other compressor body 112, 110. As a result, multiple compression chambers 122 are formed between the scroll ribs 114, 118 and the bases 120, 116 of the compressor bodies 112, 110. Within the chambers 122, progressive compression of refrigerant takes place. Refrigerant flows with an initial low pressure via an intake area 124 surrounding the scroll ribs 114, 118 in the outer radial region (see e.g. FIGS. 2-3). Following the progressive compression in the chambers 122 (as the chambers progressively are defined radially inward), the refrigerant exits via a compression outlet 126 which is defined centrally within the base 116 of the fixed scroll compressor body 110. Refrigerant that has been compressed to a high pressure can exit the chambers 122 via the compression outlet 126 during operation of the scroll compressor.

The moveable scroll compressor body 112 engages the eccentric offset drive section 74 of the drive shaft 46. More specifically, the receiving portion of the moveable scroll compressor body 112 includes a cylindrical bushing drive hub 128 which slideably receives the eccentric offset drive section 74 with a slideable bearing surface provided therein. In detail, the eccentric offset drive section 74 engages the cylindrical drive hub 128 in order to move the moveable scroll compressor body 112 about an orbital path about the central axis 54 during rotation of the drive shaft 46 about the central axis 54. Considering that this offset relationship causes a weight imbalance relative to the central axis 54, the assembly preferably includes a counter weight 130 that is mounted at a fixed angular orientation to the drive shaft 46. The counter weight 130 acts to offset the weight imbalance caused by the eccentric offset drive section 74 and the moveable scroll compressor body 112 that is driven about an orbital path (e.g. among other things, the scroll rib is not equally balanced). The counter weight 130 includes an attachment collar 132 and an offset weight region 134 (see counter weight shown best in FIG. 2) that provides for the counter weight effect and thereby balancing of the overall weight of the rotating components about the central axis 54 in cooperation with a lower counterweight 135 for balancing purposes. This provides for reduced vibration and noise of the overall assembly by internally balancing or cancelling out inertial forces.

Figure 2:
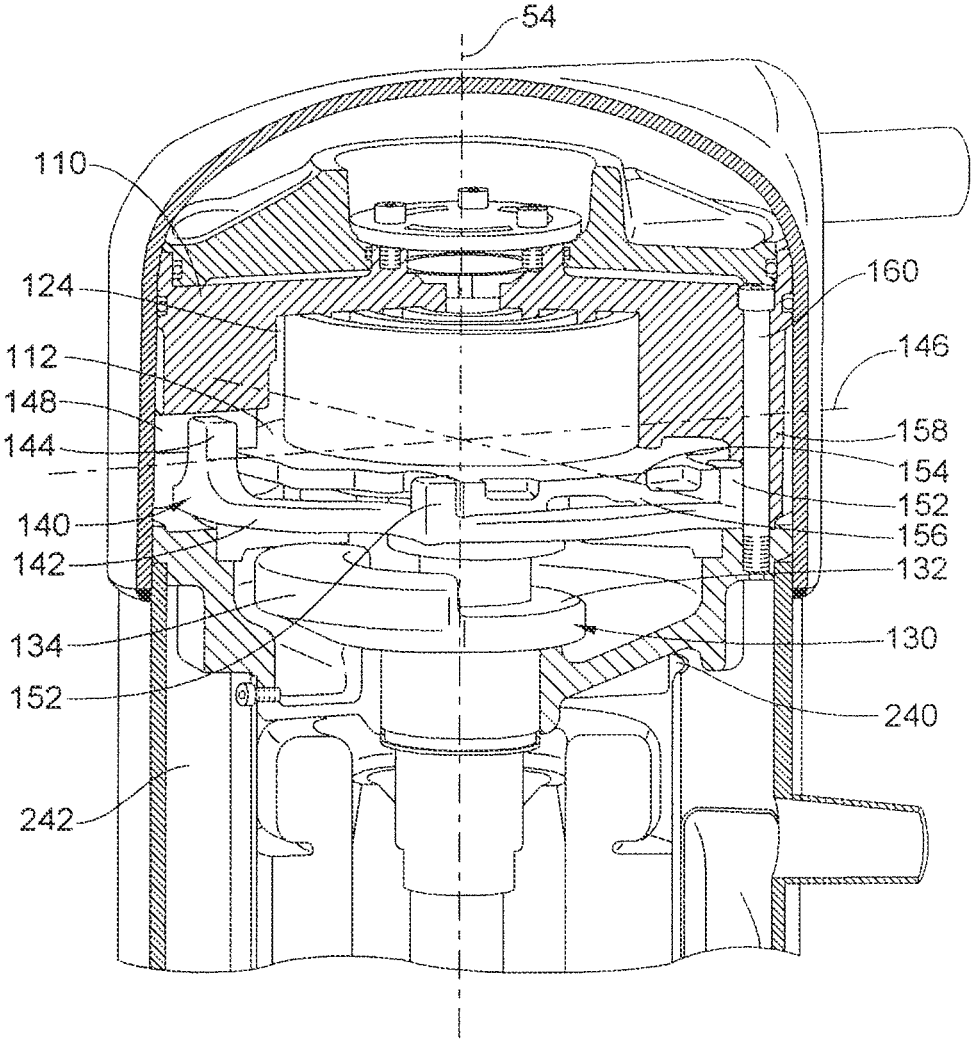
FIG. 2 is a partial cross section and cut-away view of an isometric drawing of an upper portion of the scroll compressor embodiment shown in FIG. 1.
Figure 3:
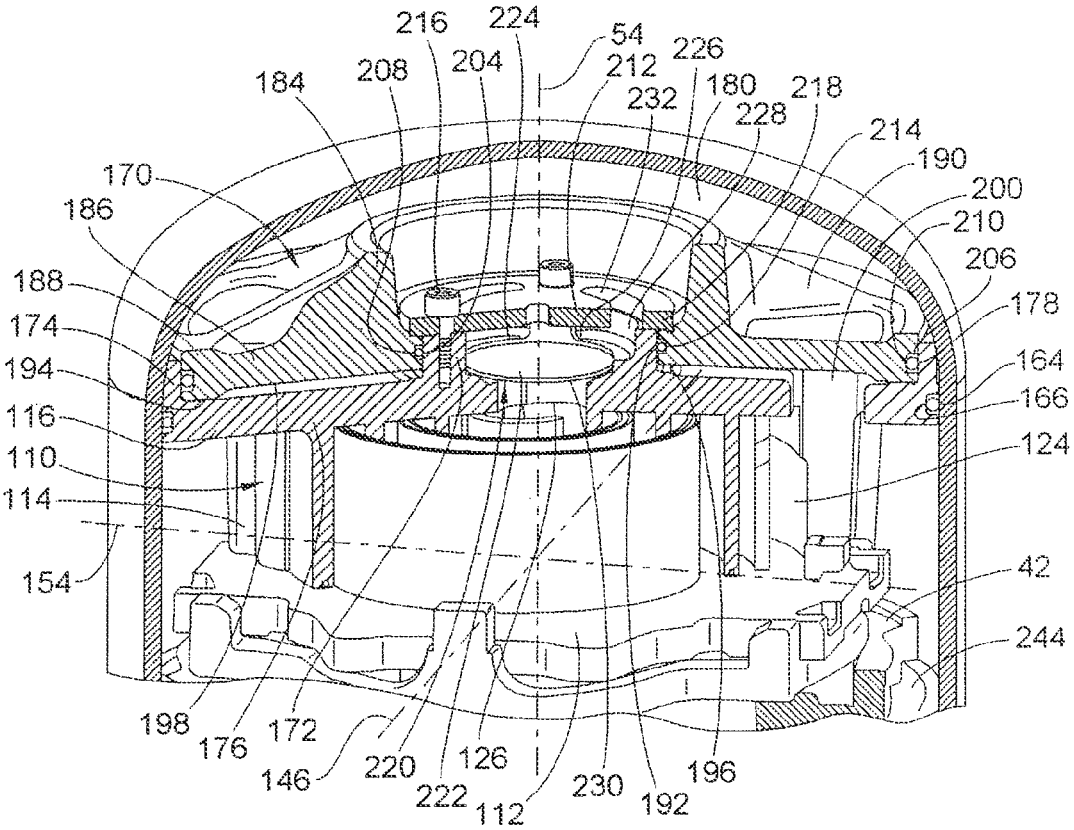
FIG. 3 is a similar view to FIG. 2 but enlarged and taken about a different angle and section in order to show other structural features.

With reference to FIGS. 1-3, and particularly FIG. 2, the guiding movement of the scroll compressor can be seen. To guide the orbital movement of the moveable scroll compressor body 112 relative to the fixed scroll compressor body 110, an appropriate key coupling 140 may be provided. Keyed couplings are often referred to in the scroll compressor art as an "Oldham Coupling." In this embodiment, the key coupling 140 includes an outer ring body 142 and includes two first keys 144 that are linearly spaced along a first lateral axis 146 and that slide closely and linearly within two respective keyway tracks 148 that are linearly spaced and aligned along the first axis 146 as well. The key way tracks 148 are defined by the stationary fixed scroll compressor body 110 such that the linear movement of the key coupling 140 along the first lateral axis 146 is a linear movement relative to the outer housing 12 and perpendicular to the central axis 54. The keys can comprise slots, grooves or, as shown, projections which project from the ring body 142 of the key coupling 140. This control of movement over the first lateral axis 146 guides part of the overall orbital path of the moveable scroll compressor body 112.

Additionally, the key coupling includes four second keys 152 in which opposed pairs of the second keys 152 are linearly aligned substantially parallel relative to a second traverse lateral axis 154 that is perpendicular to the first lateral axis 146. There are two sets of the second keys 152 that act cooperatively to receive projecting sliding guide portions 156 that project from the base 120 on opposite sides of the moveable scroll compressor body 112. The guide portions 156 linearly engage and are guided for linear movement along the second traverse lateral axis by virtue of sliding linear guiding movement of the guide portions 156 along sets of the second keys 152.

By virtue of the key coupling 140, the moveable scroll compressor body 112 has movement restrained relative to the fixed scroll compressor body 110 along the first lateral axis 146 and second traverse lateral axis 154. This results in the prevention of any relative rotation of the moveable scroll body as it allows only translational motion. More particularly, the fixed scroll compressor body 110 limits motion of the key coupling 140 to linear movement along the first lateral axis 146; and in turn, the key coupling 140 when moving along the first lateral axis 146 carries the moveable scroll 112 along the first lateral axis 146 therewith. Additionally, the moveable scroll compressor body can independently move relative to the key coupling 140 along the second traverse lateral axis 154 by virtue of relative sliding movement afforded by the guide portions 156 which are received and slide between the second keys 152. By allowing for simultaneous movement in two mutually perpendicular axes 146, 154, the eccentric motion that is afforded by the eccentric offset drive section 74 of the drive shaft 46 upon the cylindrical drive hub 128 of the moveable scroll compressor body 112 is translated into an orbital path movement of the moveable scroll compressor body 112 relative to the fixed scroll compressor body 110.

Referring in greater detail to the fixed scroll compressor body 110, this body 110 is fixed to the upper bearing member 42 by an extension extending axially and vertically therebetween and around the outside of the moveable scroll compressor body 112. In the illustrated embodiment, the fixed scroll compressor body 110 includes a plurality of axially projecting legs 158 (see FIG. 2) projecting on the same side as the scroll rib from the base 116. These legs 158 engage and are seated against the top side of the upper bearing member 42. Preferably, bolts 160 (FIG. 2) are provided to fasten the fixed scroll compressor body 110 to the upper bearing member 42. The bolts 160 extend axially through the legs 158 of the fixed scroll compressor body and are fastened and screwed into corresponding threaded openings in the upper bearing member 42. For further support and fixation of the fixed scroll compressor body 110, the outer periphery of the fixed scroll compressor body includes a cylindrical surface 162 that is closely received against the inner cylindrical surface of the outer housing 10 and more particularly the top end housing section 26. A clearance gap between surface 162 and side wall 32 serves to permit assembly of upper housing 26 over the compressor assembly and subsequently to contain the O-ring seal 164. An O-ring seal 164 seals the region between the cylindrical locating surface 162 and the outer housing 112 to prevent a leak path from compressed high pressure fluid to the un-compressed section/sump region inside of the outer housing 12. The seal 164 can be retained in a radially outward facing annular groove 166.

With reference to FIGS. 1-3 and particularly FIG. 3, the upper side (e.g. the side opposite the scroll rib) of the fixed scroll 110 supports a floatable baffle member 170. To accommodate the same, the upper side of the fixed scroll compressor body 110 includes an annular and more specifically cylindrical inner hub region 172 and an outwardly spaced peripheral rim 174 which are connected by radially extending disc region 176 of the base 116. Between the hub 172 and the rim 174 is provided an annular piston-like chamber 178 into which the baffle member 170 is received. With this arrangement, the combination of the baffle member 170 and the fixed scroll compressor body 110 serve to separate a high pressure chamber 180 from lower pressure regions within the housing 10. While the baffle member 170 is shown as engaging and constrained radially within the outer peripheral rim 174 of the fixed scroll compressor body 110, the baffle member 170 could alternatively be cylindrically located against the inner surface of the outer housing 12 directly.

As shown in the embodiment, and with particular reference to FIG. 3, the baffle member 170 includes an inner hub region 184, a disc region 186 and an outer peripheral rim region 188. To provide strengthening, a plurality of radially extending ribs 190 extending along the top side of the disc region 186 between the hub region 184 and the peripheral rim region 188 may be integrally provided and are preferably equally angularly spaced relative to the central axis 54. The baffle member 170 in addition to tending to separate the high pressure chamber 180 from the remainder of the outer housing 12 also serves to transfer pressure loads generated by high pressure chamber 180 away from the inner region of the fixed scroll compressor body 110 and toward the outer peripheral region of the fixed scroll compressor body 110.

At the outer peripheral region, pressure loads can be transferred to and carried more directly by the outer housing 12 and therefore avoid or at least minimize stressing components and substantially avoid deformation or deflection in working components such as the scroll bodies. Preferably, the baffle member 170 is floatable relative to the fixed scroll compressor body 110 along the inner peripheral region. This can be accomplished, for example, as shown in the illustrated embodiment by a sliding cylindrical interface 192 between mutually cylindrical sliding surfaces of the fixed scroll compressor body and the baffle member along the respective hub regions thereof. As compressed high pressure refrigerant in the high pressure chamber 180 acts upon the baffle member 170, substantially no load may be transferred along the inner region, other than as may be due to frictional engagement. Instead, an axial contact interface ring 194 is provided at the radial outer periphery where the respective rim regions are located for the fixed scroll compressor body 110 and the baffle member 170.

Preferably, an annular axial gap 196 is provided between the innermost diameter of the baffle member 170 and the upper side of the fixed scroll compressor body 110. The annular axial gap 196 is defined between the radially innermost portion of the baffle member and the scroll member and is adapted to decrease in size in response to a pressure load caused by high pressure refrigerant compressed within the high pressure chamber 180. The gap 196 is allowed to expand to its relaxed size upon relief of the pressure and load.

To facilitate load transfer most effectively, an annular intermediate or lower pressure chamber 198 is defined between the baffle member 170 and the fixed scroll compressor body 110. This intermediate or lower pressure chamber can be subject to either the lower sump pressure as shown, or can be subject to an intermediate pressure (e.g. through a fluid communication passage defined through the fixed scroll compressor body to connect one of the individual compression chambers 122 to the chamber 198). Load carrying characteristics can therefore be configured based on the lower or intermediate pressure that is selected for best stress/deflection management. In either event, the pressure contained in the intermediate or low pressure chamber 198 during operation is substantially less than the high pressure chamber 180 thereby causing a pressure differential and load to develop across the baffle member 170.

To prevent leakage and to better facilitate load transfer, inner and outer seals 204, 206 may be provided, both of which may be resilient, elastomeric O-ring seal members. The inner seal 204 is preferably a radial seal and disposed in a radially inwardly facing inner groove 208 defined along the inner diameter of the baffle member 170. Similarly the outer seal 206 can be disposed in a radially outwardly facing outer groove 210 defined along the outer diameter of the baffle member 170 in the peripheral rim region 188. While a radial seal is shown at the outer region, alternatively or in addition an axial seal may be provided along the axial contact interface ring 194.

While the baffle member 170 could be a stamped steel component, preferably and as illustrated, the baffle member 170 comprises a cast and/or machined member (and may be aluminum) to provide for the expanded ability to have several structural features as discussed above. By virtue of making the baffle member in this manner, heavy stamping of such baffles can be avoided.

Additionally, the baffle member 170 can be retained to the fixed scroll compressor body 110. Specifically, as can be seen in the figures, a radially inward projecting annular flange 214 of the inner hub region 184 of the baffle member 170 is trapped axially between the stop plate 212 and the fixed scroll compressor body 110. The stop plate 212 is mounted with bolts 216 to a fixed scroll compressor body 210. The stop plate 212 includes an outer ledge 218 that projects radially over the inner hub 172 of the fixed scroll compressor body 110. The stop plate ledge 218 serves as a stop and retainer for the baffle member 170. In this manner, the stop plate 212 serves to retain the baffle member 170 to the fixed scroll compressor body 110 such that the baffle member 170 is carried thereby.

As shown, the stop plate 212 can be part of a check valve 220. The check valve includes a moveable valve plate element 222 contained within a chamber defined in the outlet area of the fixed scroll compressor body within the inner hub 172. The stop plate 212 thus closes off a check valve chamber 224 in which the moveable valve plate element 222 is located. Within the check valve chamber there is provided a cylindrical guide wall surface 226 that guides the movement of the check valve 220 along the central axis 54. Recesses 228 are provided in the upper section of the guide wall 226 to allow for compressed refrigerant to pass through the check valve when the moveable valve plate element 222 is lifted off of the valve seat 230. Openings 232 are provided in the stop plate 212 to facilitate passage of compressed gas from the scroll compressor into the high pressure chamber 180. The check valve is operable to allow for one way directional flow such that when the scroll compressor is operating, compressed refrigerant is allowed to leave the scroll compressor bodies through the compression outlet 126 by virtue of the valve plate element 222 being driven off of its valve seat 230. However, once the drive unit shuts down and the scroll compressor is no longer operating, high pressure contained within the high pressure chamber 180 forces the moveable valve plate element 222 back upon the valve seat 230. This closes off check valve 220 and thereby prevents backflow of compressed refrigerant back through the scroll compressor.

During operation, the scroll compressor assembly 10 is operable to receive low pressure refrigerant at the housing inlet port 18 and compress the refrigerant for delivery to the high pressure chamber 180 where it can be output through the housing outlet port 20. As is shown, in FIG. 4, an internal conduit 234 can be connected internally of the housing 12 to guide the lower pressure refrigerant from the inlet port 18 into the motor housing via a motor housing inlet 238. This allows the low pressure refrigerant to flow across the motor and thereby cool and carry heat away from the motor which can be caused by operation of the motor. Low pressure refrigerant can then pass longitudinally through the motor housing and around through void spaces therein toward the top end where it can exit through a plurality of motor housing outlets 240 (see FIG. 2) that are equally angularly spaced about the central axis 54.

The motor housing outlets 240 may be defined either in the motor housing 48, the upper bearing member 42 or by a combination of the motor housing and upper bearing member (e.g. by gaps formed therebetween as shown in FIG. 2). Upon exiting the motor housing outlet 240, the low pressure refrigerant enters an annular chamber 242 formed between the motor housing and the outer housing. From there, the low pressure refrigerant can pass through the upper bearing member through a pair of opposed outer peripheral through ports 244 that are defined by recesses on opposed sides of the upper bearing member 42 to create gaps between the bearing member 42 and housing 12 as shown in FIG. 3 (or alternatively holes in bearing member 42). The through ports 244 may be angularly spaced relative to the motor housing outlets 240.

Upon passing through the upper bearing member 42, the low pressure refrigerant finally enters the intake area 124 of the scroll compressor bodies 110, 112. From the intake area 124, the lower pressure refrigerant finally enters the scroll ribs 114, 118 on opposite sides (one intake on each side of the fixed scroll compressor body) and is progressively compressed through chambers 122 to where it reaches it maximum compressed state at the compression outlet 126 where it subsequently passes through the check valve 220 and into the high pressure chamber 180. From there, high pressure compressed refrigerant may then pass from the scroll compressor assembly 10 through the refrigerant housing outlet port 20.

In accordance with the present invention, the illustrated embodiment includes improvements in relation to the key coupling, which will additionally be focused upon below.

Figure 5:
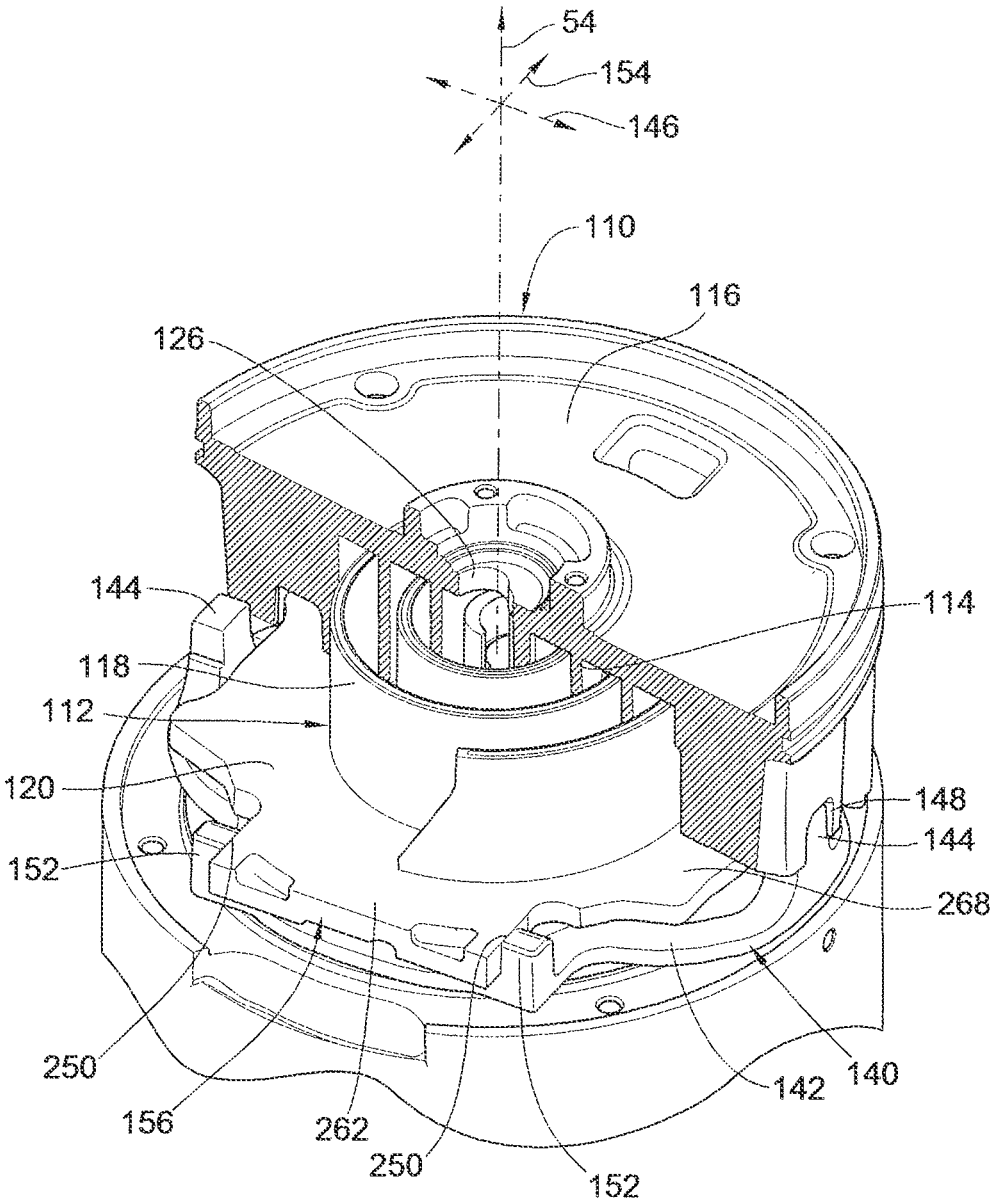
FIG. 5 is a partially cross sectional cutaway symmetric view of the scroll compressor bodies and an Oldham key coupling in accordance with an embodiment of the present invention.
Figure 6:
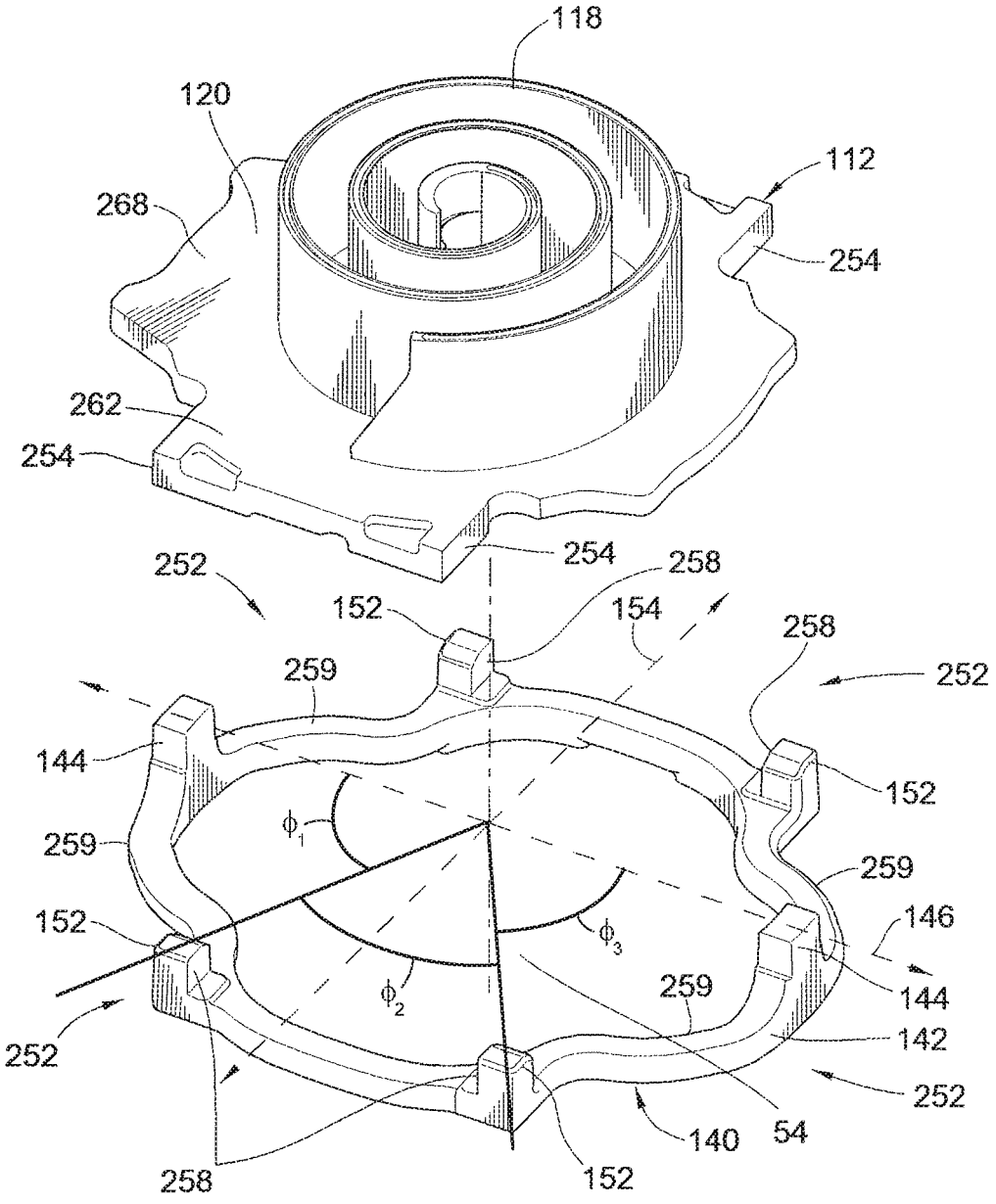
FIG. 6 is an exploded view of the moveable scroll member and the Oldham key coupling used in previous embodiments.
Figure 7:
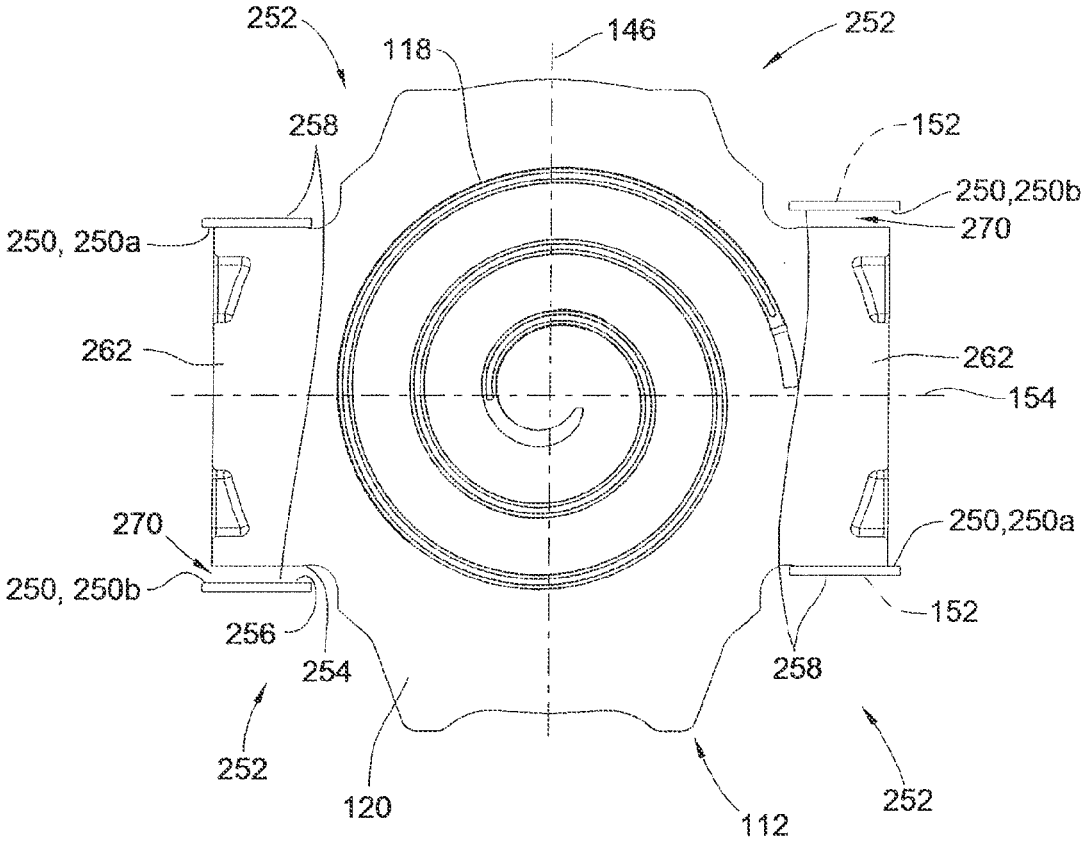
FIG. 7 is a top view of the moveable scroll member shown with running clearances (in which the running clearances are greatly exaggerated for demonstrative purposes) and Oldham key contacts shown in accordance with an embodiment of the present invention.

Referring to FIGS. 5-7 and particularly FIG. 7, it can be seen that four sliding contacts 250 are provided between the key coupling 140 and the moveable scroll compressor body 112. As shown, each of the sliding contacts 250 is contained in its own separate quadrant 252 (the quadrants 252 being defined by the mutually perpendicular lateral axes 146, 154). Each sliding contact 250 can be provided by a sliding face 254 (e.g. such as an edge) defined by the moveable scroll compressor body and another sliding face 256 defined by one of the keys 152 of the key coupling 140. As shown, cooperating pairs 258 of sliding contacts 250 are provided on each side of the first lateral axis 146.

Preferably, four keys 152 are provided by the key coupling 140 and project from the ring body 142 to provide for the sliding faces 256, with the keys 152 projecting axially from the ring body 142 toward the moveable scroll compressor body 112. Alternatively, it is also contemplated and herein disclosed that the reverse may be true in that all or some of the keys may project from the base 120 of the moveable scroll compressor body 112 instead.

As illustrated, guide portions 156 of the moveable scroll compressor body base 120 are provided by laterally extending flange portion 262 projecting in opposite directions along the second lateral axis 154 in an outward direction away from the moveable compressor body scroll rib 118. By projecting away from the scroll rib 118, the flange portions 262 can provide edges for the sliding faces 254 which lie in a plane parallel with a plane defined by the central axis 54 and the second lateral axis 154. Additionally, it can be seen that the flange portions 262 intersect and lie generally symmetrical upon the second lateral axis 154.

Figure 10:
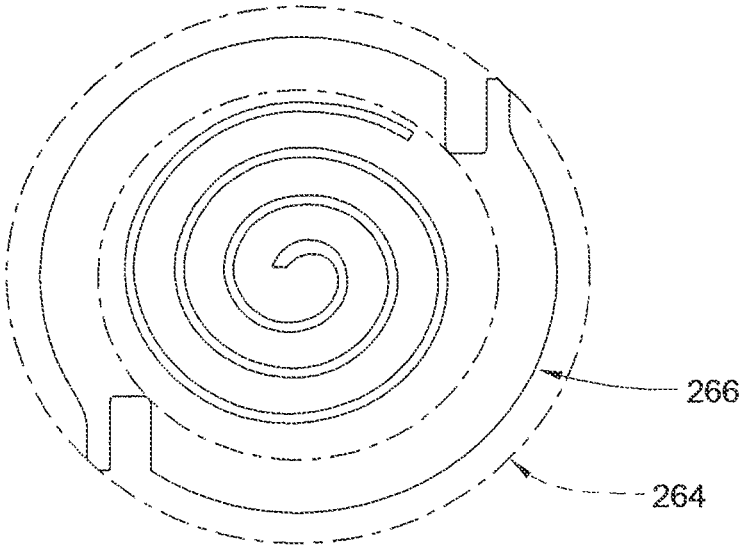
FIG. 10 is a top view of a moveable scroll member using a more conventional two slot arrangement for receiving two keys of an Oldham coupling.

Preferably, and as illustrated in the figures, the base 120 of the moveable scroll compressor body 112 is slot free and need not define a slot due to the key coupling afforded with this design as compared with, for example, a more conventional design as illustrated in FIG. 10. One benefit of this approach is that space need not be occupied by outwardly projecting ears from the scroll base in order to interact with the Oldham key coupling. As in the present design, there are no ear structures and as a result the overall diameter of the package can be reduced. For example, for a scroll compressor having at least a thirty ton capacity output, the housing can have a diameter of less than 320 millimeters.

The reduction in size that can be realized by eliminating the ear structures is shown in FIG. 10 by schematically illustrating the diameter 264 with the ears and a smaller diameter 266 that can be realized without the ears. In particular, the center shell can be reduced in diameter to under 310 millimeters to as little as 305 millimeters while providing up to thirty-five tons of capacity or even potentially more with a suitable motor (e.g. a forty ton capacity may be possible). This can all be done while also realizing a significant weight savings, including roughly between 5-10 kilograms in weight savings of the shell alone due to the decreased diameter. This can provide significant benefits in relation to lightening the overall weight of the scroll compressor assembly 10 and thereby make it more attractive for several reasons including easier manipulation, easier installation, and material savings. In contrast, comparable thirty-two ton scroll compressor displacement capacities have had shell sizes of greater than 330 millimeters such as 331 or 333 millimeters for example.

To carry axial thrust loads, the moveable scroll compressor body 112 also includes flange portions 268 projecting in a direction perpendicular relative to the guiding flange portions 262 (e.g. along the first lateral axis 146). These additional flange portions 268 are preferably contained within the diametrical boundary created by the guide flange portions 262 so as to best realize the size reduction benefits. Yet a further advantage of this design is that the sliding faces 254 of the moveable scroll compressor body 112 are open and not contained within a slot. This is advantageous during manufacture in that it affords subsequent machining operations such as finishing milling for creating the desirable tolerances and running clearances as may be desired.

As explained above and as shown in FIG. 6, the key coupling 140 has six separate "towers", or keys 144, 152, one for each engagement surface. The six keys 144, 152 all project from the same substantially planar ring body 142. In the key coupling 140, the mounting zones are located between the orbiting and fixed key surfaces for each half of the ring. That is each orbiting scroll surface 258 and adjacent fixed scroll surface 144 is separated by a mounting zone 259. Thus, the key coupling 140 has four mounting zones 259, where at least a portion of the four top surfaces of the four mounting zones 259 lie in a first common plane, and at least a portion of the four bottom surfaces of the four mounting zones 259 lie in a second common plane parallel to the first common plane. The arrangement of the mounting zones 259 is such that the configurations shown result in an increase in the spacing between orbiting scroll key surfaces 258, which, in turn, reduces the unit loading on each key surface 258 due to the wider spacing of the orbiting scroll surfaces 258.

The spacing of the keys 144, 152, and the common plane of sections of the ring body 142 joining keys, are related to each other. In a particular embodiment, the two first keys 144 are aligned with the first lateral axis 146 (as shown in FIG. 6), and the two first keys 144 are spaced further away from the second lateral axis 144 than any of the four second keys 152. One benefit of the design for the key coupling 140, shown in FIGS. 5-7, is that it minimizes the diameter of the key coupling 140 and scroll assembly 14, thus making it possible for compressor housings 12 of a given diameter to house larger scroll assemblies 14 than in conventional designs. By extending the upper connecting section around the outside of the orbiting scroll body 112 it will be necessary to provide additional radial space inside the housing to accommodate the extended section. In our design, where the connecting sections are all located below the orbiting scroll base (and generally within its perimeter) we need only provide radial space to accommodate the scroll itself.

The entire ring body 142 of key coupling 140, including the four mounting zones 259, runs underneath the orbiting scroll body 112 with individual projections 144 and 152 for all key surfaces of both orbiting and fixed scroll bodies 112, 110 projecting axially from a substantially planar ring body 142. In comparison to conventional key couplings, the claimed key coupling 140 provides more latitude in the shape of the orbiting scroll baseplate 268 and reduces the load acting on each of the orbiting scroll keys 258.

Spacing the four second keys 152 uniformly between the two first keys 144 is a balancing act between torque reduction at one end of the spectrum, i.e., the four second keys 152 being close to each other and farthest from the two first keys 144, and, at the other end of the spectrum, maximum space savings and high torque, i.e., the four second keys 152 being close to the two first keys 144. Embodiments of the present invention space the four second keys 152 in a way that results in torque reduction and space savings. In a particular embodiment, a pair of orbiting scroll key surfaces 258 (e.g., the pair of key surfaces 258 on either the left side or the right side of FIG. 7) is spaced such that, when the moveable scroll compressor body 112 is centered on the key coupling 140, any line, i.e., an imaginary line, which can be drawn between the pair of orbiting scroll key surfaces 258 does not intersect any portion of the scroll rib 118 on the moveable scroll compressor body 112.

In a more particular embodiment, the pair of orbiting scroll key surfaces 258, the two first keys 144 are located at positions corresponding to zero and 180 degrees on the key coupling 140, and two of the second keys 152 are located such that one of the two second keys 152 is spaced from 35 degrees to 55 degrees relative to one of the first keys 144, while second of the two second keys 152 is spaced from negative 35 degrees to negative 55 degrees relative to the same first key 144. Similarly, the remaining two of the second keys 152 are located such that one of the remaining two second keys 152 is spaced from 35 degrees to 55 degrees relative to the other of the first keys 144, while second of the remaining two second keys 152 is spaced from negative 35 degrees to negative 55 degrees relative to the other first key 144. The aforementioned spacing between adjacent keys 144, 152 is illustrated in FIG. 6, which, for the sake of simplicity, shows only three exemplary angles ($\Phi_1$, $\Phi_2$, $\Phi_3$) separating four adjacent keys 144, 152 over one half of the key coupling 140.

In an alternate embodiment, the two first keys 144 are located at positions corresponding to zero and 180 degrees on the key coupling 140, and two of the second keys 152 are located such that one of the two second keys 152 is spaced from 25 degrees to 65 degrees relative to one of the first keys 144, and the other of the two second keys 152 is spaced from negative 25 degrees to negative 65 degrees relative to the same first key 144. In this alternate embodiment, the remaining two of the second keys 152 are located such that one of the remaining second keys 152 is spaced from 25 degrees to 65 degrees relative to the other of the first keys 144, while the second of the remaining second keys 152 is spaced from negative 25 degrees to negative 65 degrees relative to the other first key 144. In a further embodiment, the six keys 144, 152 are spaced somewhat uniformly around the ring body 142 such that any two adjacent keys 144, 152 have an angular separation of between 55 degrees and 65 degrees. In specific embodiments, each of the six keys 144, 152 is spaced 60 degrees from any adjacent keys 144, 152.

In a further embodiment, the key coupling 140 includes a first two second keys 152 that are located on a first portion of the ring body 142 furthest from one side of the first lateral axis 146 such that no part of the ring body 142 extends farther from the first lateral axis 146 the tow second keys. Additionally, in this embodiment, the key coupling 142 further includes another two second keys 152 that are located on a second portion of the ring body 142 furthest from the other side of the first lateral axis 146 opposite the one side.

During normal operation of the compressor 10, a torque is applied to the orbiting scroll body 112 attempting to make it rotate in the counterclockwise direction. The orbiting scroll body 112 is constrained from rotating by contact between the sliding faces 254 of the moveable scroll compressor body 112 and two diagonally-separated orbiting scroll key surfaces 258 on the key coupling 140 (see FIG. 7). The magnitude of the torque is determined by the geometry of the scroll and by the inlet and outlet pressures.

To determine the net force acting on each of the orbiting scroll key surfaces 258, the torque value is divided by the linear distance between the two orbiting scroll key surfaces 258. Typically, this distance is measured between center points on the two orbiting scroll key surfaces 258. The larger this distance, the larger the denominator of the torque relation and thus the smaller the resulting contact force between the two orbiting scroll key surfaces 258.

Preferably, but optionally in relation to this application, a non-symmetrical contact relationship is also provided between the key coupling and at least one of the scroll compressor bodies as illustrated in FIG. 7. In comparing the non-symmetrical arrangement of FIG. 7 with a symmetrical arrangement of FIGS. 8 and 9, it is demonstrated that symmetric contact placement can cause unwanted rotation and edge loading of key surfaces indicated in FIG. 9. Each of these figures show exaggerated placement of running clearances 270 considering running clearances are typically on the order of between ten micron and one hundred micron from a manufacturing design standpoint (not counting tolerances). Such running clearances 270 are provided to allow for easy sliding movement of the moveable scroll compressor body 112 along the second lateral axis 154 and to allow for easier assembly.

Figure 8:
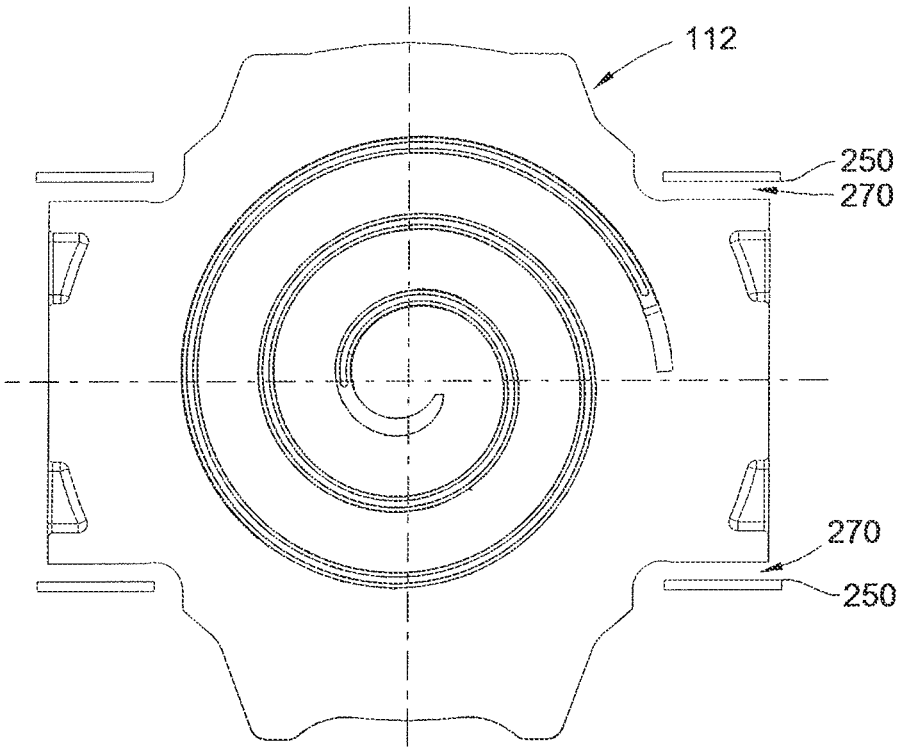
FIGS. 8 and 9 are illustrations similar to FIG. 7 except showing a symmetrical Oldham key placement (again with exaggerated running clearances shown) to illustrate that some unwanted rotation of the scroll and edge loading of key surfaces could otherwise occur without the non-symmetrical key contact surfaces of FIG. 7.
Figure 9:
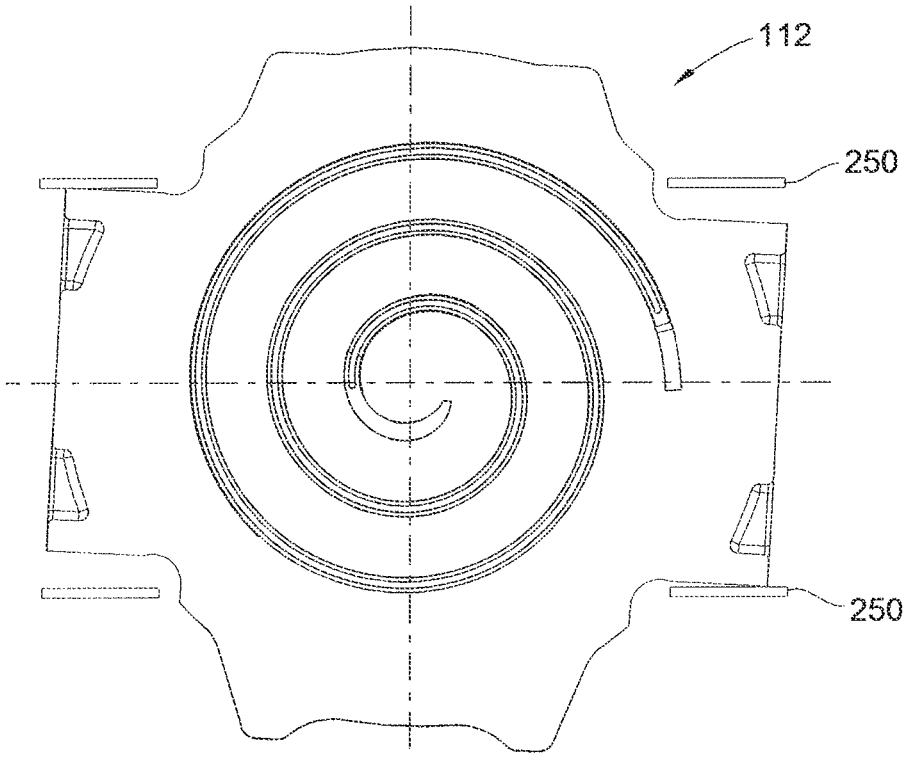

For example, manufacturing tolerances may cause the surfaces to be slightly greater or less. Also some running clearance should be provided to facilitate sliding movement as opposed to a press fit relationship or otherwise a binding relationship due to frictional forces, expansion/contraction due to temperature differentials that might occur either temporarily or otherwise, and for other similar reasons. Preferably and as illustrated in FIG. 7, the running clearance 270 is not equal for each pair 258 of sliding contacts 250. In particular, sliding contacts 250*a*, which continuously engage during operation, are set at about or around a zero running clearance while all or most of the running clearance is provided by sliding contacts 250*b*. Sliding contacts 250*b* can engage, for example, when the scroll compressor is shut down and to prevent relative rotation in the opposite direction and thereby keep the scroll compressor restrained for linear translation along the second lateral axis 154. For illustrative purposed only, it should be noted that the sliding contacts 250 shown in FIGS. 7-9 are drawn to be larger than the actual orbiting scroll key surfaces 258 shown, for example, in FIGS. 5 and 6.

There are various ways to accomplish the non-symmetrical running clearance placement including having the sliding faces 256 of the keys slightly offset and not symmetrical about the second lateral axis and/or having the sliding faces 254 of the moveable scroll compressor body 112 slightly offset and/or not symmetrical relative to the second lateral axis 154, or a combination of both. As shown in drawings such as FIG. 7, each individual pair 258 of the keys 152 are non-symmetrically placed such that one key of the pair is placed slightly farther from the second lateral axis 154 as compared to the other key of that pair. This offset placement of adjacent keys minimizes scroll rotation and provides parallel surface loading of the scroll compressor body sliding faces 254 and key coupling sliding faces 256 during normal operation when loads are being experienced on contacts 250*a* during compression of refrigerant.

Again, considering that contacts 250*b* are not so loaded during normal operation, providing the running clearance primarily or in full along sliding contacts 250*b* even though it may allow for slightly greater counter rotation of the scroll compressor body upon shut down is not of as much importance due to the fact that unwanted rotation of the scroll and edge loading of the key surfaces is more critical while the scroll compressor is actively operating and subject to high loads on a continuous basis. The contrast can be seen between FIGS. 7 and 9, in that the scroll compressor body is driven truer to the second lateral axes as shown in FIG. 7 whereas some unwanted rotation of the scroll and edge loading of key surfaces can occur as shown in FIG. 9 as the moveable scroll compressor body 112 of FIG. 9 linearly translates along the second lateral axis.

The above described embodiment and the alternatives in relation thereto (e.g. as to where the offset placement of running clearance may be provided) hereby provide means for correcting clearance backlash due to the provision of running clearance.

It should be appreciated that a similar provision can also be provided in an embodiment such as shown in FIG. 10 for a more conventional key coupling. Specifically, such a non-symmetric relationship can similarly be used by placing the running clearance along one of the slot walls in this design so as to similarly correct unwanted rotation and to keep the sliding faces of the keys in the slots more parallel during operation to prevent unwanted edge loading.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A scroll compressor, comprising:

a housing;

scroll compressor bodies including a fixed scroll compressor body and a moveable scroll compressor body, the moveable scroll compressor body being moveable relative to the housing, the scroll compressor bodies having respective bases and respective scroll ribs that project from the respective bases and which mutually engage, the scroll ribs substantially surrounding a central axis, wherein the scroll compressor bodies are moveable relative to one another along first and second lateral axes, the first and second lateral axes and the central axis being substantially mutually perpendicular; and a key coupling including a ring body, six boss portions projecting vertically from the ring body; and six keys, each of the six keys projecting vertically from a respective one of the six boss portions, and each of the six keys engaging either the fixed or the moveable scroll compressor body;

wherein the six keys are spaced around the ring body such that any two adjacent keys have an angular separation less than or equal to 65 degrees.

2. The scroll compressor of claim 1, wherein each of the six boss portions includes a flat elevated surface adjacent to the key projecting from that boss portion.

3. The scroll compressor of claim 1, wherein each of the six keys includes a step on at least one side of the key.

4. The scroll compressor of claim 1, wherein four of the six keys each includes a vertically-oriented contact face that slidingly engages a flange portion of the moveable scroll compressor body.

5. The scroll compressor of claim 4, wherein the vertically-oriented contact face is adjacent a horizontally-oriented contact face that slidingly engages a bottom edge of the flange portion of the moveable scroll compressor body.

6. The scroll compressor of claim 1, wherein the six keys include first, second, third, and fourth keys with each of the first, second, third, and fourth keys being in a separate one of four quadrants defined by the first and second lateral axes, the six keys further including fifth and sixth keys which are received in first and second keyway slots defined by the fixed scroll compressor body, respectively, the fifth and sixth keys and the first and second keyway slots being aligned along the first lateral axis.

7. The scroll compressor of claim 6, wherein the ring body has four mounting zones, each mounting zone being a portion of the ring body that connects one of the fifth and sixth keys to an adjacent one of the first, second, third and fourth keys, wherein each of the mounting zones has a top surface, and wherein each of the four top surfaces includes a flat portion, and each of the four flat portions lies in a common plane.

8. The scroll compressor of claim 6, wherein the fifth and sixth keys are aligned with the first lateral axis and, wherein the fifth and sixth keys are spaced further from the second lateral axis than any of the at least four keys.

9. The scroll compressor of claim 6, wherein the first key is spaced from 25 degrees to 65 degrees relative to the fifth key, and the second key is spaced from negative 25 degrees to negative 65 degrees relative to the fifth key; and wherein the third key is spaced from 25 degrees to 65 degrees relative to the sixth key, and the fourth key is spaced from negative 25 degrees to negative 65 degrees relative to the sixth key.

10. The scroll compressor of claim 6, wherein the first key is spaced from 35 degrees to 55 degrees relative to the fifth key, and the second key is spaced from negative 35 degrees to negative 55 degrees relative to the fifth key; and wherein the third key is spaced from 35 degrees to 55 degrees relative to the sixth key, and the fourth key is spaced from negative 35 degrees to negative 55 degrees relative to the sixth key.

11. The scroll compressor of claim 6, wherein the six keys are spaced around the ring body such that any two adjacent keys have an angular separation of between 55 degrees and 65 degrees.

12. A scroll compressor, comprising:

scroll compressor bodies including a fixed scroll compressor body and a moveable scroll compressor body, the fixed and moveable scroll compressor bodies having respective bases and respective scroll ribs that project from the respective bases and which mutually engage, the scroll ribs substantially surrounding a central axis, wherein the scroll compressor bodies are moveable relative to one another along first and second lateral axes, the first and second lateral axes and the central axis all intersecting at a point and being substantially mutually perpendicular;

a key coupling including a ring body and six keys projecting vertically above the ring body, the six keys including first, second, third, and fourth keys arranged in a rectangular configuration, and configured to engage first and second guiding flanges that form part of a base for the moveable scroll compressor body, the first and second guiding flanges projecting in directions that are parallel to the second lateral axis, the moveable scroll compressor body further including plate members that form a part of the base different from that formed by the first and second guiding flanges, the plate members projecting in directions that are parallel to the first lateral axis;

wherein the first, second, third, and fourth keys each include a first contact face that allows the moveable scroll compressor body to move linearly relative to the key coupling by a contact interface between the key coupling and the moveable scroll compressor body;

wherein the six keys are s paced around the ring body such that any two adjacent keys have an angular separation less than or equal to 65 degrees.

13. The scroll compressor of claim 12, wherein the first, second, third, and fourth keys each include a second contact face that engages a bottom edge of one of the first and second guiding flanges to maintain a horizontally level position of the moveable scroll compressor body.

14. The scroll compressor of claim 12, wherein the six keys include fifth and sixth keys configured to interface with the fixed scroll compressor body, the fifth and sixth keys being aligned with the first lateral axis, and spaced further from the second lateral axis than any of the first, second, third, and fourth keys.

15. The scroll compressor of claim 14, wherein the ring body has four mounting zones, each mounting zone being a portion of the ring body that connects one of the fifth and sixth keys to an adjacent one of the first, second, third and fourth keys, wherein each of the four mounting zones has a top surface that includes a flat portion, and wherein each of the four flat portions lies in a common plane.

16. The scroll compressor of claim 12, wherein the six keys are spaced around the ring body such that any two adjacent keys have an angular separation of between 55 degrees and 65 degrees.

17. The scroll compressor of claim 12, wherein the first key is spaced from 25 degrees to 65 degrees relative to the fifth key, and the second key is spaced from negative 25 degrees to negative 65 degrees relative to the fifth key; and wherein the third key is spaced from 25 degrees to 65 degrees relative to the sixth key, and the fourth key is spaced from negative 25 degrees to negative 65 degrees relative to the sixth key.

18. The scroll compressor of claim 12, wherein the first key is spaced from 35 degrees to 55 degrees relative to the fifth key, and the second key is spaced from negative 35 degrees to negative 55 degrees relative to the fifth key; and wherein the third key is spaced from 35 degrees to 55 degrees relative to the sixth key, and the fourth key is spaced from negative 35 degrees to negative 55 degrees relative to the sixth key.

* * * * *